US007331086B2

(12) United States Patent
Sundermeier et al.

(10) Patent No.: US 7,331,086 B2
(45) Date of Patent: Feb. 19, 2008

(54) ARRANGEMENT AT A DRAW FRAME COMPRISING A SUCTION DEVICE FOR REMOVING DUST, FIBRE DUST AND THE LIKE

(75) Inventors: Frank Sundermeier, Wegberg (DE); Josef Temburg, Jüchen (DE); Robert Többen, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 533 days.

(21) Appl. No.: 10/960,954

(22) Filed: Oct. 12, 2004

(65) Prior Publication Data

US 2005/0081336 A1 Apr. 21, 2005

(30) Foreign Application Priority Data

Oct. 17, 2003 (DE) ..... 103 49 101
Aug. 5, 2004 (DE) ..... 10 2004 037 957

(51) Int. Cl.
*D01H 5/74* (2006.01)

(52) U.S. Cl. ..... 19/258

(58) Field of Classification Search ..... 19/236, 19/258

See application file for complete search history.

(56) References Cited

U.S. PATENT DOCUMENTS 4,630,336 A * 12/1986 Schopwinkel et al. ..... 19/288
4,922,580 A * 5/1990 Bothner et al. ..... 19/288
5,305,498 A * 4/1994 Lang ..... 19/263
6,052,984 A * 4/2000 Summerer ..... 57/315
6,209,303 B1 * 4/2001 Stahlecker ..... 57/304
6,604,261 B2 * 8/2003 Stoll et al. ..... 19/236
6,988,355 B2 * 1/2006 Stahlecker et al. ..... 57/315
2001/0020357 A1 * 9/2001 Dinkelmann et al. ..... 57/315
2006/0143872 A1 * 7/2006 Cherif ..... 19/236

FOREIGN PATENT DOCUMENTS

DE 36 30 941 C2 3/1988
DE 85 14 152.6 U1 4/1988

* cited by examiner

*Primary Examiner*—Shaun R. Hurley
(74) *Attorney, Agent, or Firm*—Venable LLP; Robert Kinberg; Steven J. Schwarz

(57) ABSTRACT

In an arrangement at a draw frame including a suction device for removing dust, fiber dust and the like, in which a funnel and a pair of draw-off rollers are present at the outlet of the draw frame immediately after a web-guiding element, the suction removal device is able to encompass the region between the outlet of the funnel and the nip between the draw-off rollers. In order to catch and remove waste that is released effectively, the flow channel of the suction removal device is able to substantially encompass the intake region of the funnel and projects laterally beyond the intake region of the funnel.

23 Claims, 5 Drawing Sheets

ARRANGEMENT AT A DRAW FRAME COMPRISING A SUCTION DEVICE FOR REMOVING DUST, FIBRE DUST AND THE LIKE

CROSS REFERENCE TO RELATED APPLICATION

This application claims priority from German Patent Application No. 103 49 101.5, filed Oct. 17, 2003, the entire disclosure of which is incorporated herein by reference.

BACKGROUND OF THE INVENTION

The invention relates to an arrangement at a draw frame comprising a suction device for removing dust, fibre dust and the like, in which a sliver funnel and a pair of draw-off rollers are present at the outlet of the draw frame after the drawing system.

In a known draw frame, open suction sites are arranged in the vicinity of the draw-off rollers and the sliver funnel in order to remove fibre dust that has been released. As a result of the intensive emergence of fibre and dust particles having considerable dynamic energy at locations where the fibre sliver is being compressed, the open suction sites are not able to prevent contamination of the environment sufficiently. Some of the waste particles having impetus in different directions fly past the suction sites.

It is an aim of the invention to provide an arrangement of the type described at the beginning that avoids or mitigates the mentioned disadvantages and in particular effectively catches and removes the waste that is released.

SUMMARY OF THE INVENTION

The invention provides a fibre transport assembly for use in a draw frame comprising:

- a fibre transport funnel forming a funnel intake region and having a funnel outlet;
- a pair of draw-off rollers defining a roller nip; and
- a suction removal device for applying suction in a region between the funnel outlet and the roller nip;

wherein the suction removal device comprises a flow channel which is arranged to encompass at least part of the funnel intake region.

As a result of the measures according to the invention, it is possible to enclose the sources of waste in such a manner that the streams of dust and fibre are specifically directed and conveyed to the suction sites provided for their removal. The integration of positioning elements into the geometry of the suction removal channels creates construction elements having a twofold function. In that manner, it is possible for the region between the drawing system and the draw-off rollers to be kept clean by suction removal. At the same time, accessibility for maintenance and servicing is improved considerably.

Advantageously, the flow channel is arranged or constructed to overlap the intake region of the funnel and the nip between the draw-off rollers. Advantageously, the flow channel is able to catch the dust, short fibres and the like emerging from the intake and from the outlet of the funnel. Advantageously, a cover element is present on the suction removal device, which cover element partially covers the flow channel. Advantageously, the cover element is in the form of a roof or the like. Advantageously, the cover element is constructed to overlap the intake region of the funnel and the nip between the draw-off rollers. The flow channel (viewed in the direction of fibre feed), is advantageously arranged upstream of the intake region of the funnel. Advantageously, the flow channel has suction openings which (viewed in the direction of fibre feed) are arranged upstream of the nip between the draw-off rollers. Advantageously, the cover element is constructed in two parts. Advantageously, the cover element surrounds a transfer pipe associated with the funnel. Advantageously, the transfer pipe passes through the flow channel. Advantageously, the two parts of the cover element can separated from one another. Advantageously, a web-guiding element and the transfer pipe are positioned on the fixed-position part of the cover element. Advantageously, the cover element comprises a fixed-position part and a movable part. Advantageously, the flow channel is a cast piece, e.g. cast from aluminium. Advantageously, the flow channel has at least one opening. Advantageously, a said opening faces the nip between the draw-off rollers. Advantageously, the flow channel faces the intake region of the funnel. Advantageously, the flow channel encompasses (encapsulates) the intake region of the sliver funnel and the nip between the draw-off rollers. Advantageously, a suction pipe of the suction removal device is connected to a pneumatic suction source, e.g. mechanical suction. Advantageously, the suction pipe and the movable part are mounted to pivot on a pivot bearing. Advantageously, the suction pipe and the movable part are mounted on the pivotable drawing system hood. Advantageously, the flow channel and the funnel form a constructional unit. Advantageously, the flow channel is integrated into the inlet of the funnel (funnel flap). Advantageously, a fixed-position part of the cover element and a web-guiding-positioning element form a functional unit. Moreover, the invention provides a fibre transport assembly for use in a draw frame, comprising:

- a funnel having an intake and an outlet;
- a pair of rollers arranged downstream of the sliver funnel and delivering a roller nip;
- a suction removal device having a housing defining a flow channel wherein the suction removal device housing is arranged to form an enclosed region between the funnel outlet and the roller nip, and around at least part of the funnel intake.

BRIEF DESCRIPTION OF THE DRAWINGS

With reference to FIG. 1, a draw frame, e.g. a TD 03 draw frame made by Trützschler GmbH & Co. KG of Mönchengladbach, Germany, comprises a drawing system 1 having a drawing system intake and a drawing system outlet.

Figure 1:
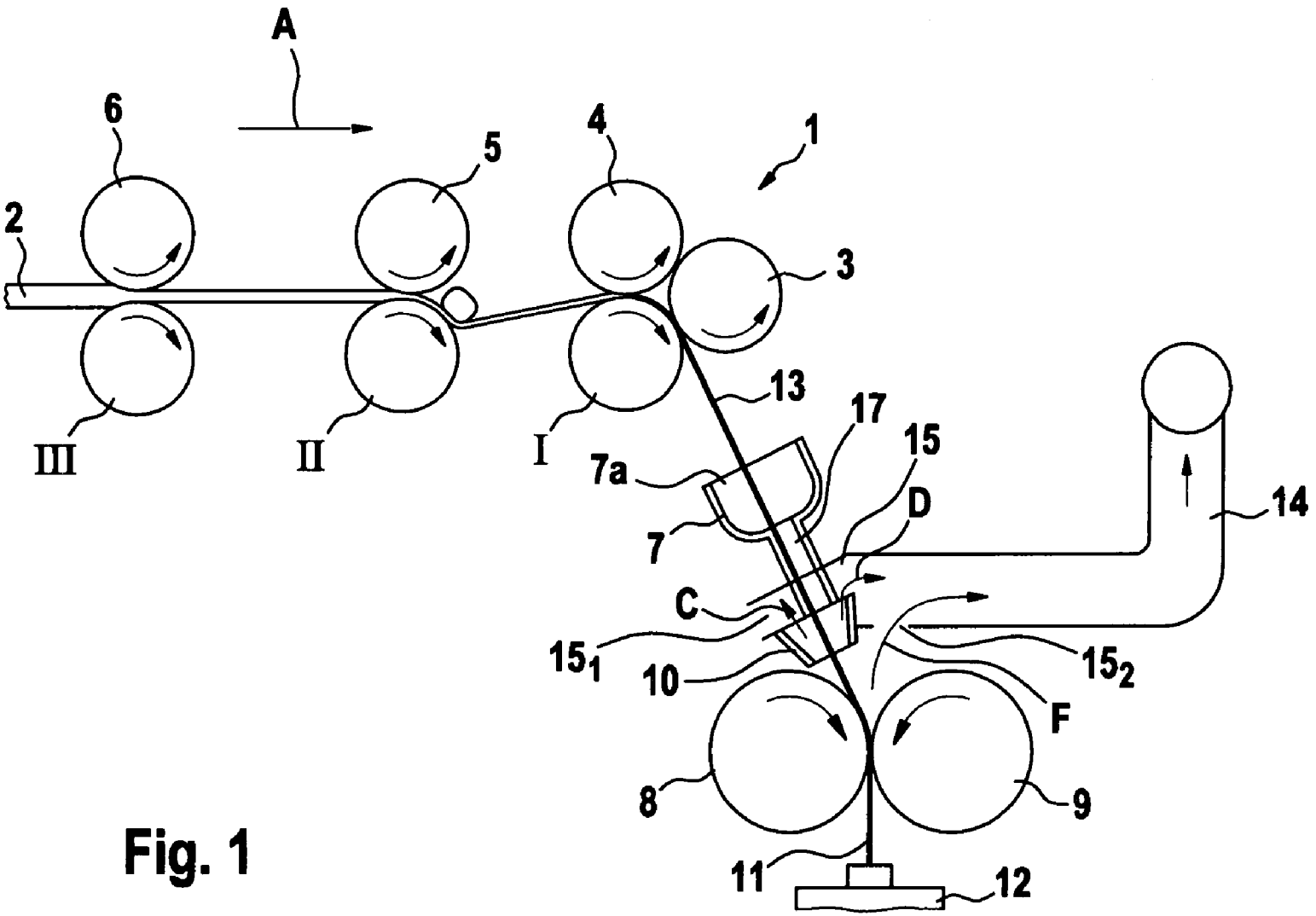
FIG. 1 is a diagrammatic side view of a web-guiding element, a sliver funnel and a pair of draw-off rollers, and an arrangement according to the invention, positioned downstream of a drawing system.

The fibre slivers 2, emerging from cans, enter a sliver guide and, drawn by draw-off rollers, are conveyed past a measuring device. The drawing system 1 is designed as a 4 over 3 drawing system, that is to say it consists of three lower rollers I, II, III (I lower output roller, II lower middle roller, III lower intake roller) and four upper rollers 3, 4, 5, 6. In the drawing system 1, the fibre bundle 2 is drawn from a plurality of fibre slivers. The draft consists of preliminary draft and main draft. The pairs of rollers 6/III and 5/II form the preliminary draft zone and the pairs of rollers 5/II and 3,4/I form the main draft zone. The drawn fibre slivers (fibre web 13) arrive at a web-guiding element 7 in the drawing system outlet and are drawn by means of the draw-off rollers 8, 9 through a sliver funnel 10, in which they are combined to form a fibre sliver 11, which is subsequently deposited in cans (not shown) by way of a can coiler 12. Reference letter A denotes the direction of feed of the fibre bundle. Between the web-guiding element 7 and the draw-off rollers 8, 9 there is a suction removal device 14. The flow channel 15 (see FIG. 2) of the suction removal device 14 is arranged upstream of the intake opening 10*a* of the sliver funnel 10 and at the outlet opening 10*b* and at the nip between the draw-off rollers 8, 9, overlapping each of them.

Figure 2:
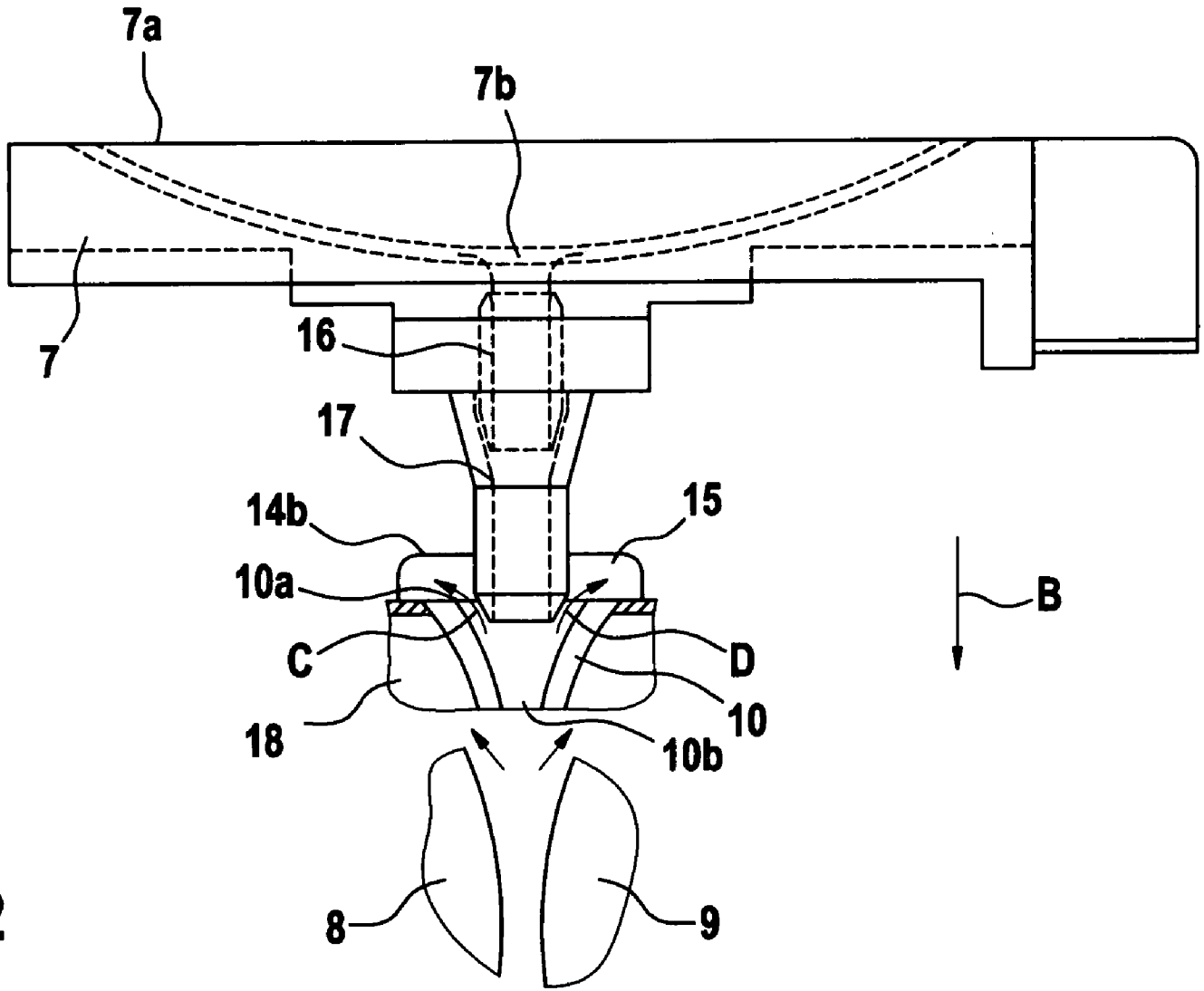
FIG. 2 is a plan view of the cross-section of the flow channel of the suction removal device in the region upstream of the sliver funnel.

According to FIG. 2, the web-guiding element 7 is of funnel-like shape and comprises an open side 7*a* (intake-side opening) and a throughput opening 7*b*. Connected to the throughput opening 7*b* are transfer pipes 16, 17 that convey the combined fibre web 13 into the web funnel 10. In operation, the fibre web introduced passes through the intake opening 10*a*, through the interior in the form of fibre sliver 11, through the outlet opening 10*b* and then through the nip a between the draw-off rollers 8, 9. The fibre material is compressed both on entering the sliver funnel 10 and in the roller nip a, air being pressed out, which air escapes in the direction of arrows C, D (at the sliver funnel 10) and E, F (at the draw-off rollers 8, 9) against the direction of feed B. Dust, fibre dust and similar waste emerge with the air and are indicated diagrammatically by the arrows C and D. The flow channel 15 of the pneumatic suction removal device 14 encompasses the intake region 10*a* of the sliver funnel 10 and in that manner removes the waste C, D by suction. Reference numeral 18 denotes the holding device for the sliver funnel 10.

Figure 3:
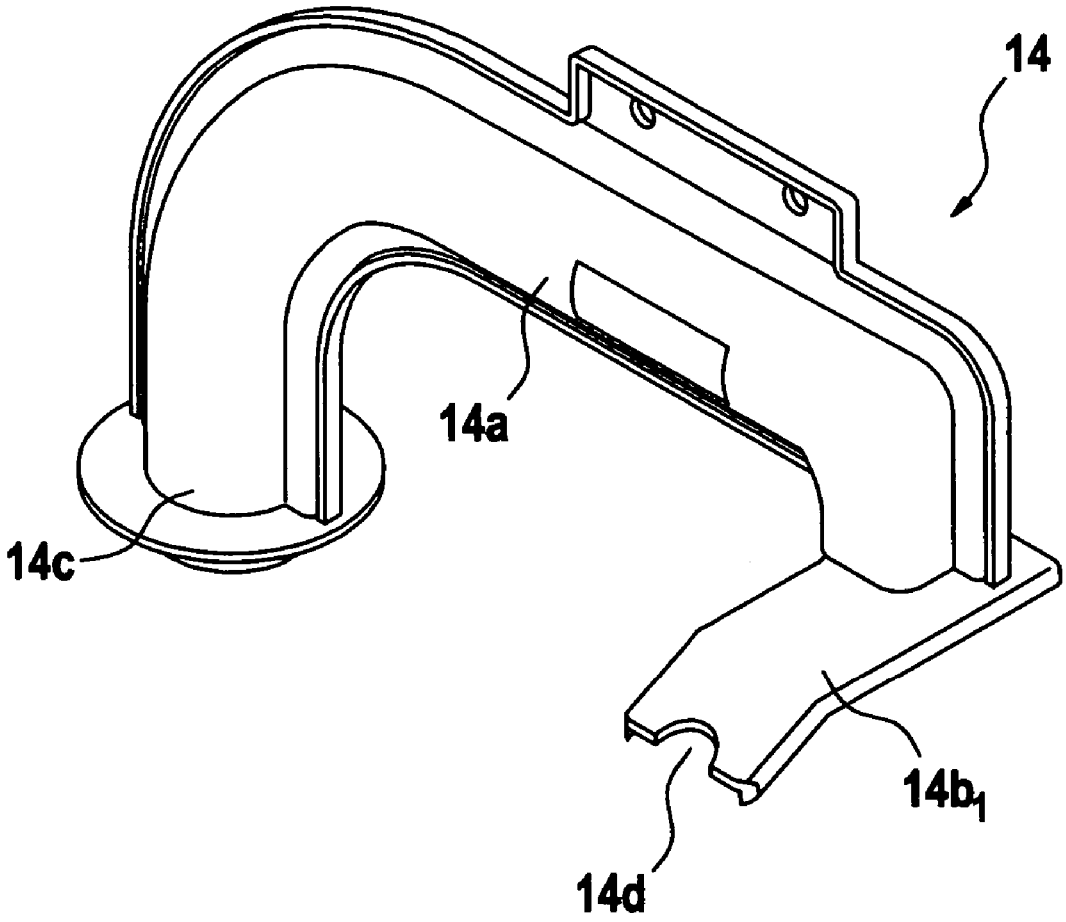
FIG. 3 is a perspective view of the suction removal pipe comprising a suction removal element to cover the flow channel.

In the embodiment of FIG. 3, the suction removal device 14 comprises a suction pipe 14*a*, at one end of which there is a cover element 14*b*. The other end 14*c* of the suction pipe 14*a* is connected to a source of suction air (not shown). The roof-like cover element 14*b* is constructed in two parts and consists of a part $\mathbf{14}b_1$ and a part $\mathbf{14}b_2$, part 14*b* being attached securely at the end of the suction pipe 14*a*. Parts $\mathbf{14}b_1$ and $\mathbf{14}b_2$ surround the transfer pipe 17, which passes through an opening 14*d* between parts $\mathbf{14}b_1$ and $\mathbf{14}b_2$ (see FIG. 4*a*).

Figure 4A:
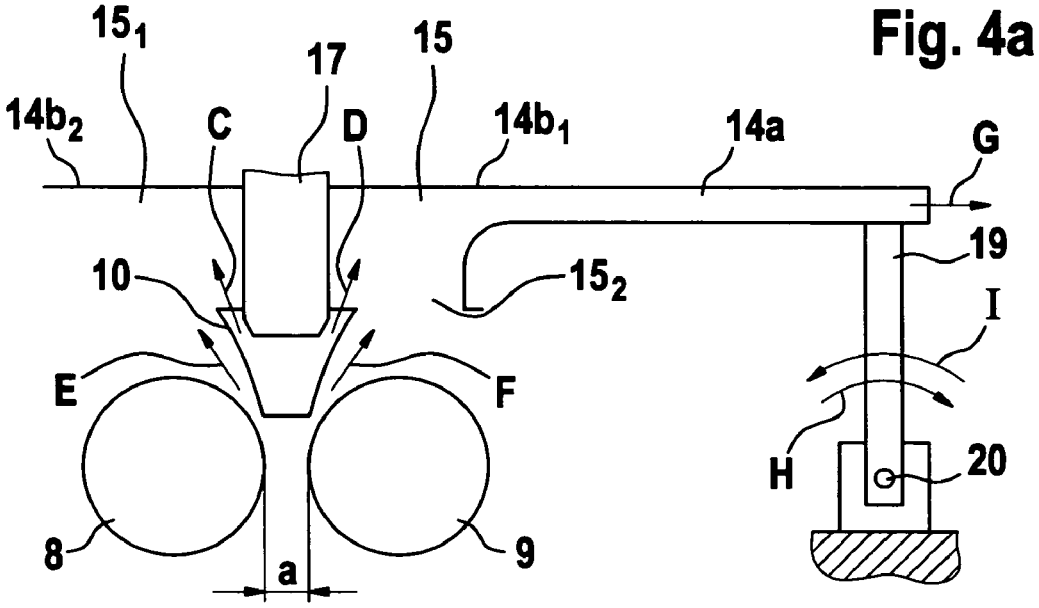
FIG. 4*a* shows a suction removal device according to the invention in the operating position.

As shown in FIG. 4*a*, the flow channel 15 is covered by the cover element 14*b*. The flow channel 15 encompasses the intake region 10*a* of the sliver funnel (10) and projects beyond the intake region 10*a* in an approximately annular manner at a lateral spacing b (see FIG. 2). As a result, an open circumferential flow channel 15 is formed. The internal wall surface of parts $\mathbf{14}b_1$ and $\mathbf{14}b_2$ is spaced at a maximum distance c from the intake opening 10*a* of the sliver funnel.

Air flows C and D enter the flow channel 15 directly and air flows E and F enter the flow channel 15 through the suction openings $\mathbf{15}_1$ and $\mathbf{15}_2$. The air flows C, D, E and F are removed by suction as air flow G by way of the suction pipe 14*a* through the flow channel 15 having the cover element 14*b*.

Figure 4B:
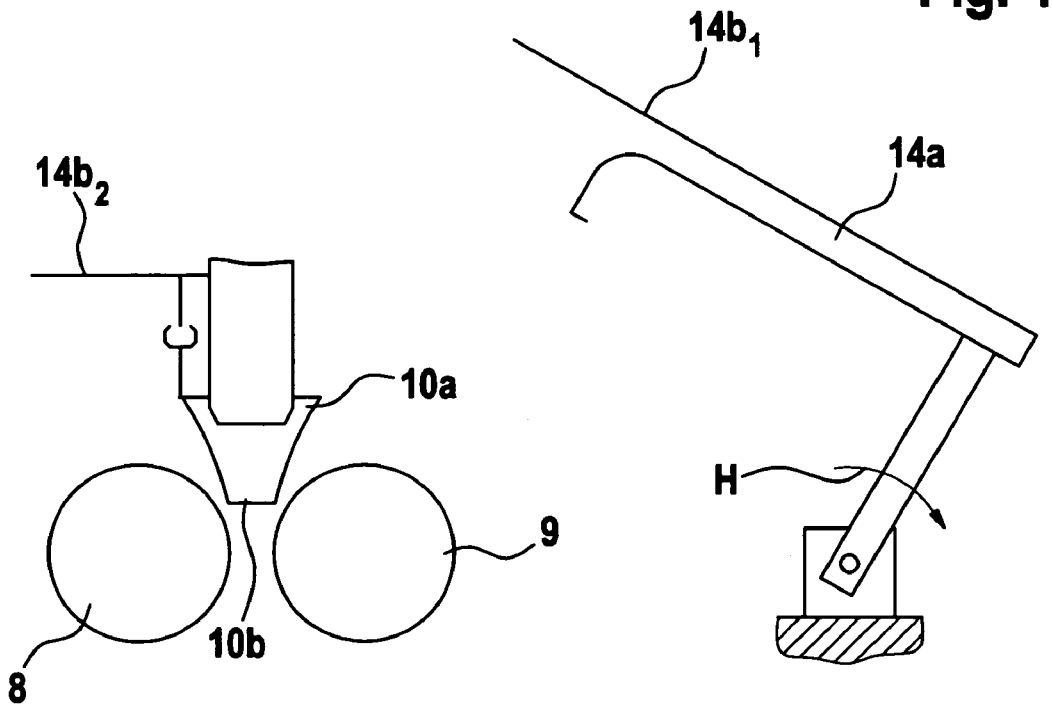
FIG. 4*b* FIG. 4*b* shows the device of FIG. 4*a* in a position in which it has been pivoted away.

In the embodiment of FIGS. 4*a* and 4*b*, the suction pipe 14*a* and the part $\mathbf{14}b_1$ are arranged to pivot in the direction of arrows H and I by way of a holding element 19 on a fixed pivot bearing 20. According to FIG. 4*a*, the suction element 14*a* and the part $\mathbf{14}b_1$ have been pivoted into the operational position. According to FIG. 4*b*, when not in operation the suction element 14*a* and part $\mathbf{14}b_1$ are pivoted out in direction H, whilst part $\mathbf{14}b_2$ remains fixed in position. As a result, the sliver funnel 10 and the draw-off rollers 8,9 are easily accessible for servicing and maintenance work.

Figure 5:
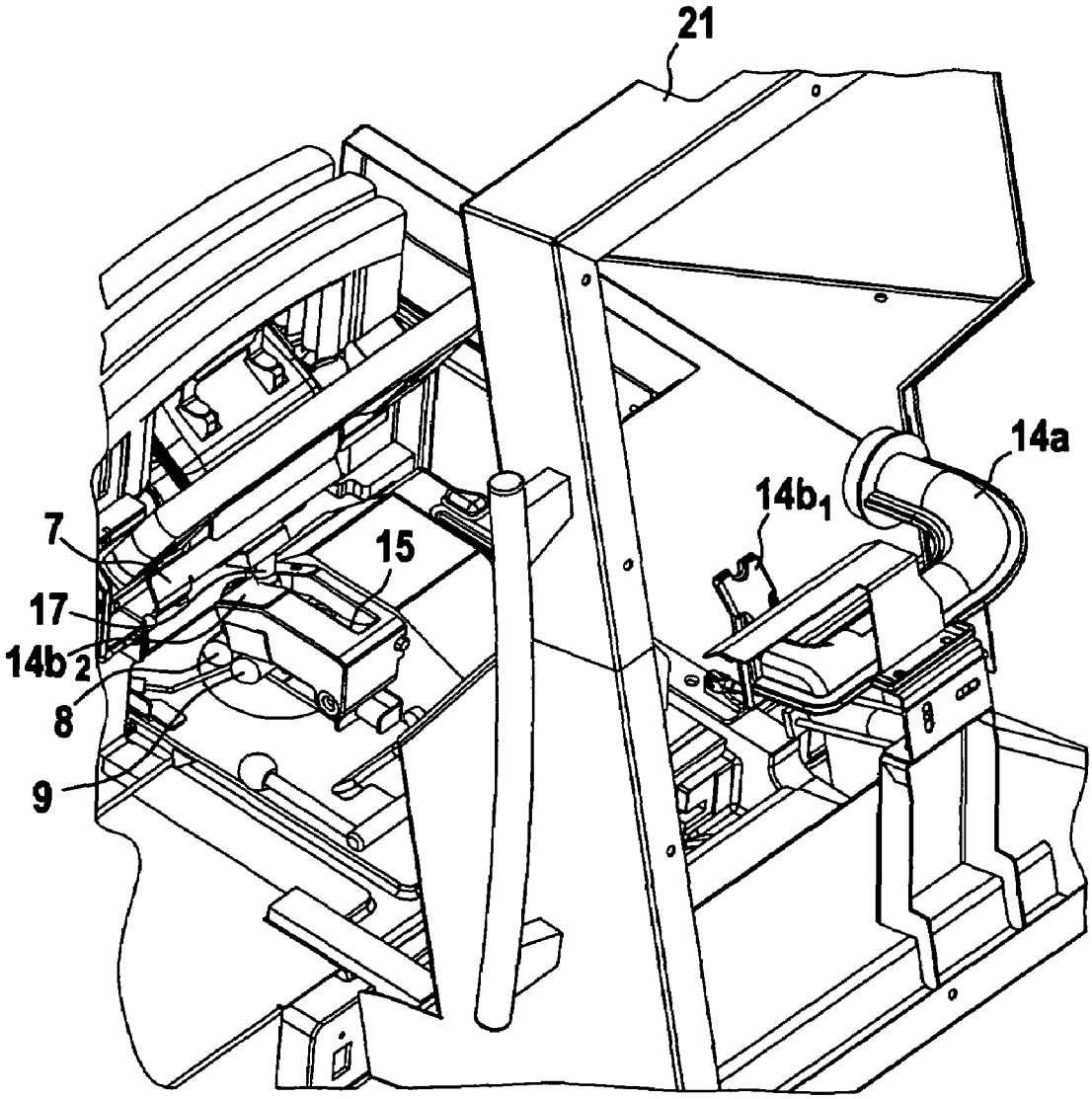
FIG. 5 is a perspective view of an arrangement according to the invention with the hood of the drawing system pivoted open.

According to FIG. 5, the drawing system hood 21 has been pivoted open, the suction pipe 14*a* mounted on the drawing system hood 21 and the part $\mathbf{14}b_1$ also having been pivoted away, so providing free access for maintenance and servicing.

Although the foregoing invention has been described in detail by way of illustration and example for purposes of understanding, it will be obvious that changes and modifications may be practised within the scope of the appended claims.

What is claimed is:

1. A fibre transport assembly for use in a draw frame comprising:

a fibre transport funnel forming a funnel intake region and having a funnel outlet;

a pair of draw-off rollers defining a roller nip;

a web-guiding element located upstream of the funnel;

a transfer pipe extending from the web-guiding element towards the funnel;

a suction removal device for applying suction in a region between the funnel outlet and the roller nip; wherein:

the suction removal device comprises a cover element partially defining a flow channel which is arranged to encompass at least part of the funnel intake region, the cover element surrounding the transfer pipe.

2. An assembly according to claim 1, in which the flow channel encompasses the funnel intake region and extends laterally beyond the funnel intake region in at least one direction.

3. An assembly according to claim 2, in which the flow channel encompasses the funnel intake region and extends laterally beyond the funnel intake region about substantially the entire circumference of the funnel.

4. An assembly according to claim 1, in which the flow channel overlaps the intake region of the funnel and said nip.

5. An assembly according to claim 1, in which the flow channel can entrap waste emerging from the fibre material at the funnel intake region and at the funnel outlet.

6. An assembly according to claim 1, in which the cover element is in the form of a roof or the like.

7. An assembly according to claim 1, in which the cover element is constructed to overlap the intake region of the sliver funnel and the nip between the draw-off rollers.

8. An assembly according to claim 1, in which the cover element is constructed in two parts.

9. An assembly according to claim 8, in which two parts of the cover element can be separated from one another.

10. An assembly according to claim 8, in which the cover element comprises a fixed-position part and a movable part.

11. An assembly according to claim 1, in which the transfer pipe passes through the flow channel.

12. An assembly according to claim 1, in which the web-guiding element and the transfer pipe are positioned on a fixed-position part of the cover element.

13. An assembly according to claim 1, in which the cover element is a cast piece.

14. An assembly according to claim 1, in which the flow channel (viewed in the direction of fibre feed), is arranged upstream of the intake region of the funnel.

15. An assembly according to claim 1, in which the flow channel comprises a plurality of suction openings which (viewed in the direction of fibre feed) are arranged upstream of the nip between the draw-off rollers.

16. An assembly according to claim 1, in which the flow channel substantially encloses (encapsulates) the intake region of the funnel and the nip between the draw-off rollers.

17. An assembly according to claim 1, in which the suction removal device comprises a suction pipe that is connected to a pneumatic suction source, for generating suction in the flow channel.

18. An assembly according to claim 17, in which the suction pipe and a movable part of a cover element of the flow channel are mounted to pivot on a pivot bearing.

19. An assembly according to claim 18, in which the suction pipe and the movable part are mounted on a pivotable carding system hood.

20. An assembly according to claim 1, in which the flow channel is integrated into the inlet of the funnel (funnel flap).

21. An assembly according to claim 1, in which the flow channel is integrated into the inlet of the funnel (funnel flap).

22. A fibre transport assembly for use in a draw frame, comprising:

a sliver funnel having an intake and an outlet;

a pair of rollers arranged downstream of the sliver funnel and defining a roller nip;

a suction removal device having a housing defining a flow channel;

a web-guiding element located upstream of the funnel; and a transfer pipe extending from the web-guiding element toward the funnel;

wherein the suction removal device housing is arranged to form an enclosed region between the funnel outlet and the roller nip, and around at least part of the funnel intake, further wherein the housing surrounds the transfer pipe.

23. An arrangement at a draw frame comprising a suction device for removing dust, fibre dust and the like, in which a sliver funnel and a pair of draw-off rollers are present at the outlet of the draw frame immediately after a web-guiding element, and a transfer pipe extends from the web-guiding element toward the funnel, the suction removal device comprising a cover element partially defining a flow channel, the cover element surrounding the transfer pipe, wherein the suction removal device is able to encompass the region between the outlet of the sliver funnel and the nip between the draw-off rollers, wherein the flow channel comprising the suction removal device is able to encompass the intake region of the sliver funnel and projects laterally beyond the intake region of the sliver funnel.

* * * * *